US006431367B1

(12) United States Patent
Satake et al.

(10) Patent No.: US 6,431,367 B1
(45) Date of Patent: Aug. 13, 2002

(54) METHOD AND APPARATUS FOR EXCHANGING SIFTER FRAMES OF A PLAN SIFTER

(75) Inventors: Satoru Satake, Tokyo; Hideki Sakaki; Akira Orihashi, both of Hiroshima, all of (JP)

(73) Assignee: Satake Corporation (JP)

( * ) Notice: Subject to any disclaimer, the term of this patent is extended or adjusted under 35 U.S.C. 154(b) by 0 days.

(21) Appl. No.: 09/679,392

(22) Filed: Oct. 3, 2000

(30) Foreign Application Priority Data

Oct. 8, 1999 (JP) ..... 11-288705

(51) Int. Cl.[7] ..... B07B 1/28

(52) U.S. Cl. ..... 209/319; 209/2; 209/404; 414/392

(58) Field of Search ..... 209/309, 363, 209/370, 371, 372, 373, 391, 405, 2, 319, 404, 935; 414/788.9, 789.7, 789.9, 390, 391, 392, 389

(56) References Cited

U.S. PATENT DOCUMENTS 3,815,741 A * 6/1974 Keller ..... 209/319
4,260,481 A * 4/1981 Keller ..... 209/315
5,095,680 A * 3/1992 Guardiola ..... 53/244
5,553,986 A * 9/1996 Napierkowski et al. ..... 414/401
5,641,260 A * 6/1997 Gray ..... 414/401
6,036,126 A * 3/2000 Cappola ..... 241/69
6,062,809 A * 5/2000 Berkey et al. ..... 414/809

FOREIGN PATENT DOCUMENTS

JP 2-15983 A * 1/1990 ..... B25H/1/04

* cited by examiner

*Primary Examiner*—Donald P. Walsh
*Assistant Examiner*—Mark J Beauchaine
(74) *Attorney, Agent, or Firm*—Wells, St. John, Roberts, Gregory & Matkin

(57) ABSTRACT

The invention provides a method for exchanging a plurality of sifter frames of a plan sifter. The steps of the method include a step, when taking out a number of sifter frames from a sifting chamber, of taking out a plurality of sifter frames in a unitary state with the unitary state being maintained to the outside of the machine frame, and a step, when accommodating new sifter frames in the sifting chamber, of stacking the sifter frames outside the machine frame and accommodating the unitary formed sifter frames in the sifting chamber. According to the method of the invention, the sifter frame exchange operation can be carried out in such a way as to reduce heavy labor and risk to workers, and such exchanging operation can be carried out in an easy manner.

15 Claims, 8 Drawing Sheets

METHOD AND APPARATUS FOR EXCHANGING SIFTER FRAMES OF A PLAN SIFTER

RELATED APPLICATIONS

This application relates to and claims priority to corresponding Japanese Patent Application No. 288705/1999 filed Oct. 8,1999 and which is incorporated by reference herein.

BACKGROUND OF THE INVENTION (1) Field of the Invention

The present invention relates to a sifter in which a plurality of sifter frames provided with sifting nets which are stacked one on top of the other within one and the same machine frame in the sequence of sizes of meshes, the machine frame being rotatingly oscillated with respect to the horizontal plane by a vertical rotary oscillating axis thereby sifting powdery particles on the basis of particle diameters, and more particularly to an apparatus for exchanging sifter frames in which, during the maintenance (exchange of the sifter frames) of the sifter, the sifter frames can be easily taken out of the machine frame.

(2) Description of the Related Art

A prior art sifter as shown in FIG. 1 is known, in which a plurality of sifter frames provided with sifting nets are stacked one on top of the other within one and the same machine frame in the sequence of sizes of meshes, the machine frame being rotatingly oscillated with respect to the horizontal plane by a vertical rotary oscillating shaft thereby sifting powdery particles on the basis of article diameters.

FIG. 1 shows an outside appearance of the prior art sifter in which a plurality of sifter frames 101 are stacked on a sifting machine frame 102, and are fixed unitarily to the sifting machine frame 102 by bolts 103 and nuts 104. The sifting nets of the sifter frames 101 are stacked one on top of the other in such a way that lower the nets are positioned the meshes of the nets gradually become finer, and that material particle objects are introduced from the topmost sifting net and finer particles can be taken out from lower sifting nets. The sifting machine frame 102 has at its central portion a vertical rotary shaft 105 for effecting rotary oscillation and, with the rotation of the rotary shaft 105, the sifting machine frame 102 is caused to oscillate in a horizontal direction. When the sifting machine frame is oscillated, the sifter frames 101 in the machine frame are also oscillated. The particle objects introduced from the inlet 106 onto the uppermost sifter frame are sifted due to the rotary oscillation of the sifting nets and different meshes of the sifting nets, and the sifted particles are discharged from the outlet 107 below. The sifter frames are supported at their four corners by glass fiber rods 108 so as to allow the oscillation of the sifter frames.

The conventional sifter is configured as above so that, for exchanging the sifter frames 101, first the bolts 103 and the nuts 104 of the sifter frames 101 which are unitarily stacked on the sifting machine frame 102 are loosened, and the sifter frames, one at a time, are taken out from the sifting machine frame 102. Thereafter, the inspection is made for any holes in the nets, the tense conditions of the nets, any leakage of particle objects, etc. and, if any problems are found, the sifter frames 101 are replaced by new ones. When exchanging for the new sifter frames 101, the reverse work is performed, that is, the sifter frames 101 are stacked in the sifting machine frame 102 one by one and, on reaching a predetermined number, they are unitarily fastened by the bolts 103 and nuts 104.

The exchanging operation as above involves heavier work as the number of the sifter frames increases. For example, in the case where there are six sifting chambers and, in each chamber, there are 20 to 30 stages of the stacks of the sifter frames 101, the time required for exchanging the sifter frames is about 80 minutes for each chamber, which means that the total time of eight hours is required for six sifting chambers and shows that such a great time is necessitated in the conventional exchanging operation.

Further, the sifter frames stacked in 20 to 30 stages reach the height of two to three meters from the ground which required working on a stepladder in a precarious condition, and there was a risk of collapsing of the stacked sifter frames. Also, the total weight of the sifter frames stacked in 20 to 30 stages amounted to 200 Kg so that the exchanging work itself involved risk.

SUMMARY OF THE INVENTION

In view of the above problems, an object of the present invention is to provide means for exchanging sifter frames which enables the reduction in the hard work involved in exchanging the sifter frames and in the exposure of the workers to the risk and which enables easy exchange of the sifter frames.

In order to solve the problem, according to one aspect of the invention, there is provided a method for exchanging sifter frames of a plan sifter, in which a plurality of sifter frames having nets of different meshes are stacked one on top of the other, the stacked sifter frames are accommodated and fixed in a sifting chamber provided within a machine frame, and the machine frame is suspended from above and caused to be oscillated for sifting powdery particles, the method comprising the steps of:

stacking the plurality of sifter frames in advance outside the machine frame and holding the sifter frames in a unitary form;

placing the unitary formed sifter frames in the sifting chamber when accommodating the sifter frames in the sifting chamber;

fixing the unitary formed sifter frames accommodated in the sifting chamber; releasing the fixing of the sifter frames when drawing out the sifter frames from the sifting chamber; and drawing out the sifter frames to outside the machine frame in the state in which the sifter frames are stacked in the unitary form.

With the above configuration, when the sifter frames are taken out from a plurality of sifting chambers provided within the machine frame, it is not necessary to take out the sifter frames one at a time from each sifting chamber to inspect the existence of any holes in the nets, any problem in the tense condition of the nets, any leakage of particle objects, etc. and then to exchange the sifter frames and, when the sifter frames are accommodated into each of the sifting chambers, the sifter frames are stacked in advance outside the machine frame and the unitary formed sifter frames are accommodated in each sifting chamber so that, even when the number of the sifter frames is large, the exchanging operation can be easily carried out. Also, the number of the stacked sifter frames can, in that state, be taken out of the machine frame. Then, the accommodated unitary formed sifter frames are fixed in each sifting chamber for sifting operation and, when the sifter frames are taken out from each sifting chamber, the fixed state of the sifter frames is released and the stacked unitary formed sifter frames are taken out of the machine frame. For example, in the case of the plan sifter where there are 20 to 30 stages of the sifter frames in each sifting chamber and there are 6 sifting chambers, the time conventionally required for exchanging operation was about 80 minutes for each chamber but this has been reduced to about 40 minutes, half the time, and in the case of the plan sifter having 6 chambers, only about 4 hours are required, half the time which was conventionally required.

According to another aspect of the invention, there is also provided an apparatus for exchanging sifter frames of a plan sifter in which a plurality of sifter frames having nets of different meshes are stacked one on top of the other, the stacked sifter frames are accommodated and fixed in a sifting chamber provided in a machine frame, and the machine frame being suspended from above and caused to be oscillated or shaken for sifting powdery particles, the apparatus comprising:

means to stack the plurality of sifter frames and hold the unitary formed sifter frames;

means to transport the unitary formed sifter frames to the sifting chamber for accommodating the sifter frames in the sifting chamber, and from the sifting chamber for drawing out the sifter frames; and means to fix the sifter frames by giving appropriate pressure vertically downwardly from above to the sifter frames accommodated in the sifting chamber.

With the sifter frame holding means, the stacked sifter frames can be unitarily held and, with the sifter frame transporting means, the sifter frames can be transported out easily to outside the machine frame. When the sifter frames are fixed within the sifting chamber, the stacked sifter frames have conventionally been fixed by bolts and nuts. However, according to the invention, the stacked sifter frames are automatically fixed or released by the sifter frame fixing means thereby enabling to reduce the heavy labor involved in the operation.

The apparatus for exchanging sifter frames of a plan sifter is one in which the means to transport the sifter frames includes a first moving cart for moving the unitary formed sifter frames from a location at which the sifter frames are in contact with the machine frame to a predetermined location different from a location of the machine frame, and a second moving cart for moving, when the first cart is at the location at which the sifter frames are in contact with the machine frame, the unitary formed sifter frames between aboard the first moving cart and inside the sifting chamber; whereby, when the sifter frames are accommodated in the sifting chamber, the first moving cart is moved to the predetermined location different from the location of the machine frame, the unitary formed sifter frames are placed via the second moving cart on the first moving cart, further the first moving cart is moved to the location at which the sifter frames are in contact with the machine frame and, after the second moving cart is moved from aboard the first moving cart to inside the sifting chamber, the second moving cart is drawn out and the sifter frames are accommodated; and when the sifter frames are drawn out from the sifting chamber, the first moving cart is moved to the location at which the sifter frames are in contact with the machine frame, the second moving cart is inserted into a bottom portion of the unitary formed sifter frames, and the second moving cart is moved from aboard the first moving cart from inside the sifting chamber and the sifter frames are drawn out. With the sifter according to this configuration, even when the sifter frames are stacked, for example, in 20 to 30 stages weighing about 200 kg, the exchanging operation is safe because of the employment of the first and the second moving carts, and moreover the exchanging operation is easy and fast.

The apparatus for exchanging sifter frames of a plan sifter is one in which the means to transport the sifter frames includes a first moving cart for moving the unitary formed sifter frames from a location at which the sifter frames are in contact with the machine frame to a predetermined location different from a location of the machine frame, and a second moving cart for moving, when the first moving cart is at the location at which the sifter frames are in contact with the machine frame, the unitary formed sifter frames between aboard the first moving cart and inside the sifting chamber; and the sifter frame fixing means includes a sifter frame fixing device provided above the sifting chamber and giving appropriate pressure vertically downwardly from above to the sifter frames accommodated in the sifting chamber, and an elevating means provided below the sifter frame fixing device and allowing the upward-and-downward movements of the unitary formed sifter frames accommodated in the sifting chamber. According to the plan sifter having this configuration, with the first moving cart, a plurality of sifter frames can be stacked in advance outside the machine frame to stand by and, with the second moving cart, the unitary formed sifter frames may be pushed into the sifting chamber so that, with a simple operation, the sifter frames can be exchanged. Also, the sifter frame fixing means facilitates the unitary formed sifter frames to be easily fixed or released. Further, when the second moving cart is drawn out from the unitary formed sifter frames at the sifting chamber, the sifter frame elevating means may be operated so that, while the unitary formed sifter frames are elevated, the second moving cart may easily be drawn out.

The apparatus for exchanging sifter frames of a plan sifter is one in which the second moving cart is configured by a cart portion in a low floor form on which the unitary formed sifter frames are placed, and by wheels provided under a bottom surface of the cart portion. The sifter frame elevating means is configured by an air cylinder for elevating the unitary formed sifter frames separately from the cart portion.

The apparatus for exchanging sifter frames of a plan sifter is one in which the second moving cart is configured by a bottom box on which the unitary formed sifter frames are placed, and by wheels provided inside the bottom box and allowed to come in and out of the bottom box; and the elevating means are configured by wheels allowed to come in and out of the bottom box.

The apparatus for exchanging sifter frames of a plan sifter is one in which the first moving cart includes a leg portion having horizontally adjusting legs and casters, a base portion supported by the leg portion, a jack portion capable of appropriately jacking up the base portion with a fulcrum point as the center, a lift base for raising the jack portion to an appropriate height, and a placement base provided on the lift base with a horizontally adjusting portion interposed therebetween. The first moving cart is enabled to move by the casters and, during the operation, the horizontally adjusting legs may be in a fixed position so as to make the moving cart stable. Further, the placement base can be adjusted by the jack portion so that the height thereof can be substantially the same as that of the bottom portion of the sifting chamber of the sifter.

Further, the apparatus for exchanging sifter frames of a plan sifter is one in which the apparatus is provided with a first lock means to fix the first moving cart and the sifting chamber, and a second lock means to fix the first moving cart and the second moving cart, the first lock means and the second lock means being used when the unitary formed sifter frames are accommodated in and taken out of the sifting chamber. When the unitary formed sifter frames are exchanged, the first and the second moving carts are prevented from moving so that even when the sifter frames are stacked, for example, in 20 to 30 stages weighing about 200 kg, the exchanging operation is safe because of the employment of the first and the second moving cart, and moreover the exchanging operation can be carried out in a safe manner.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Figure 1:
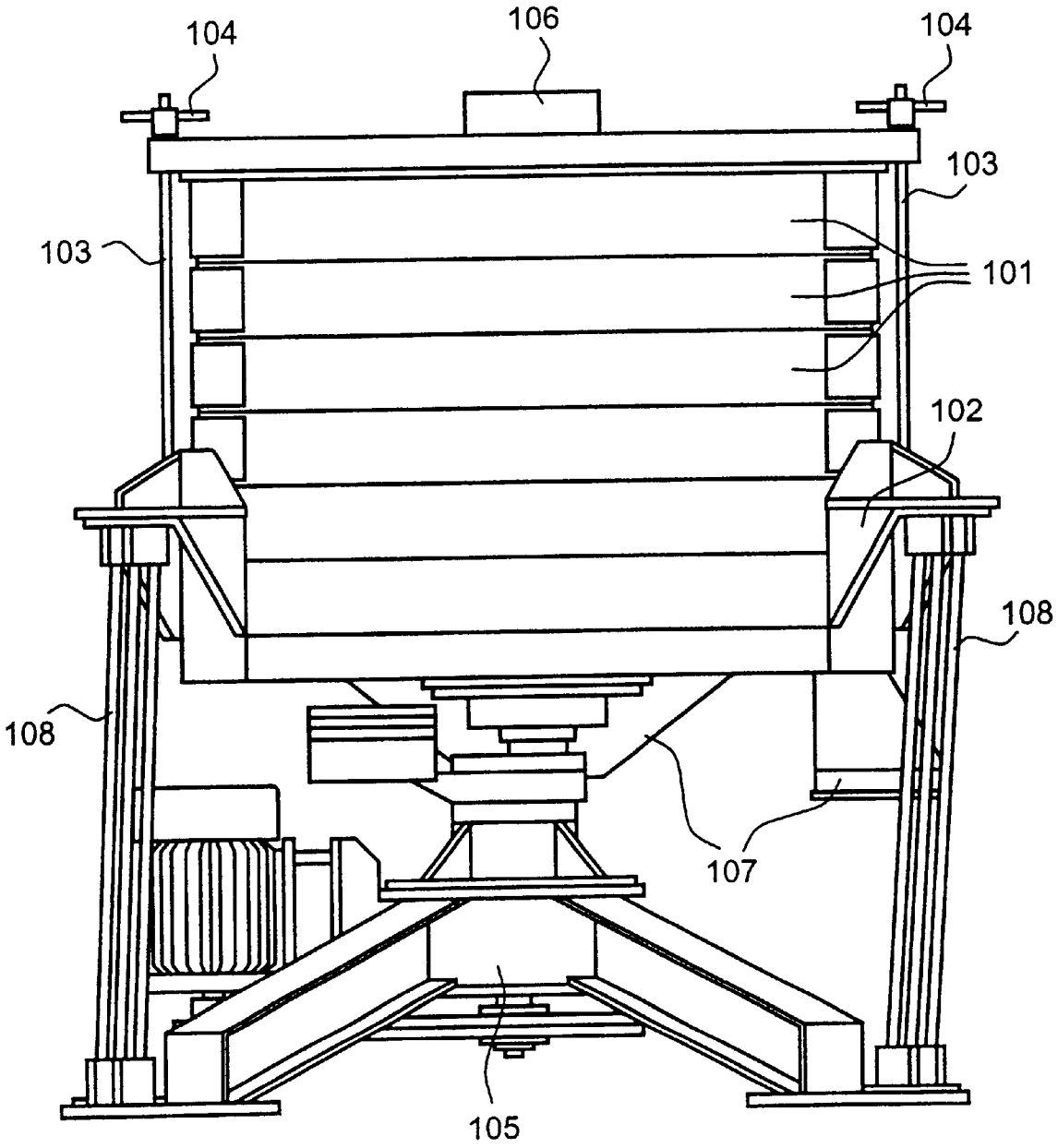
Fig. 1 PRIOR ART
FIG. 1 is an outward appearance view of a conventional sifter.
Figure 2:
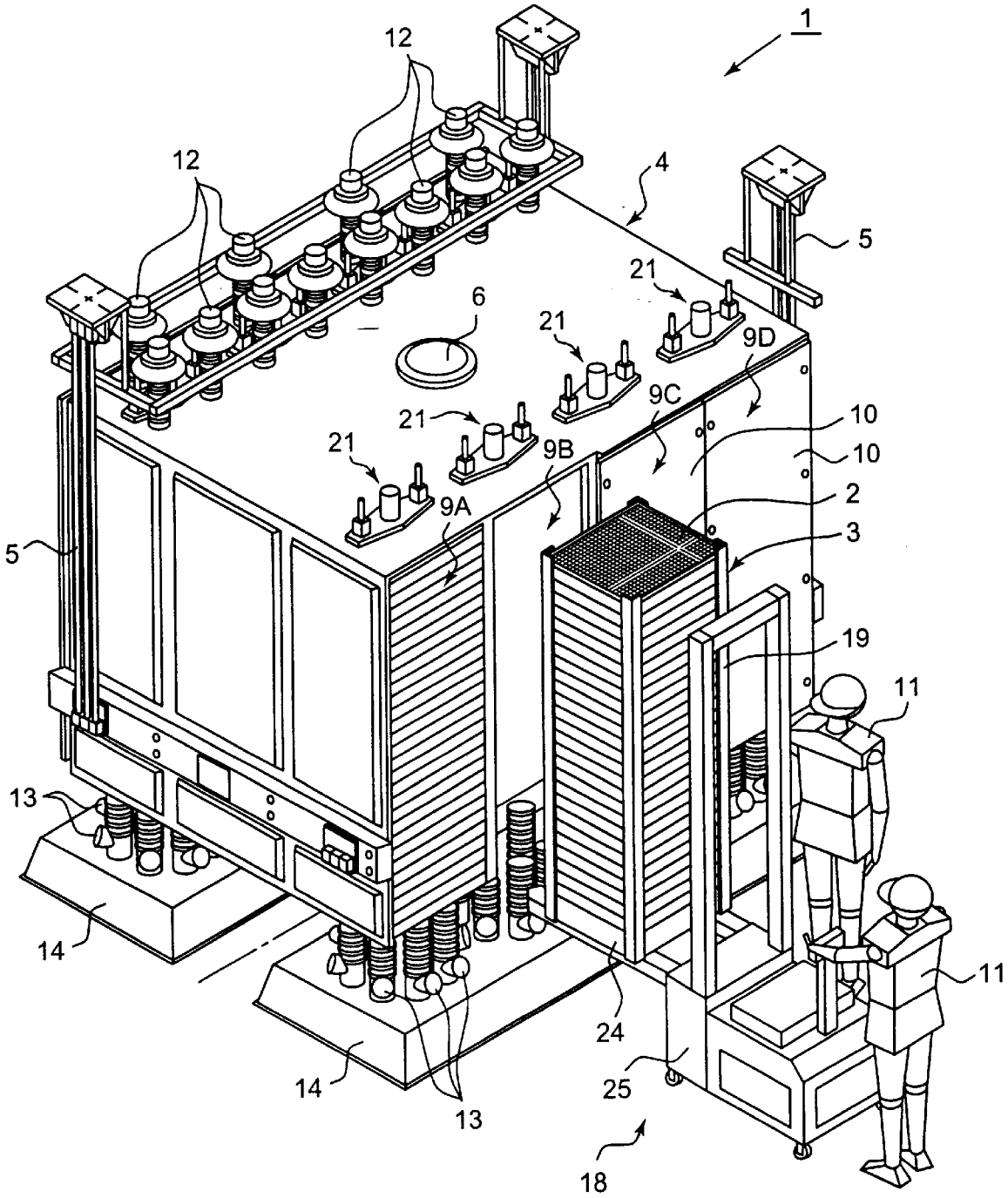
FIG. 2 is a perspective view of the entire plan sifter according to the invention.
Figure 3:
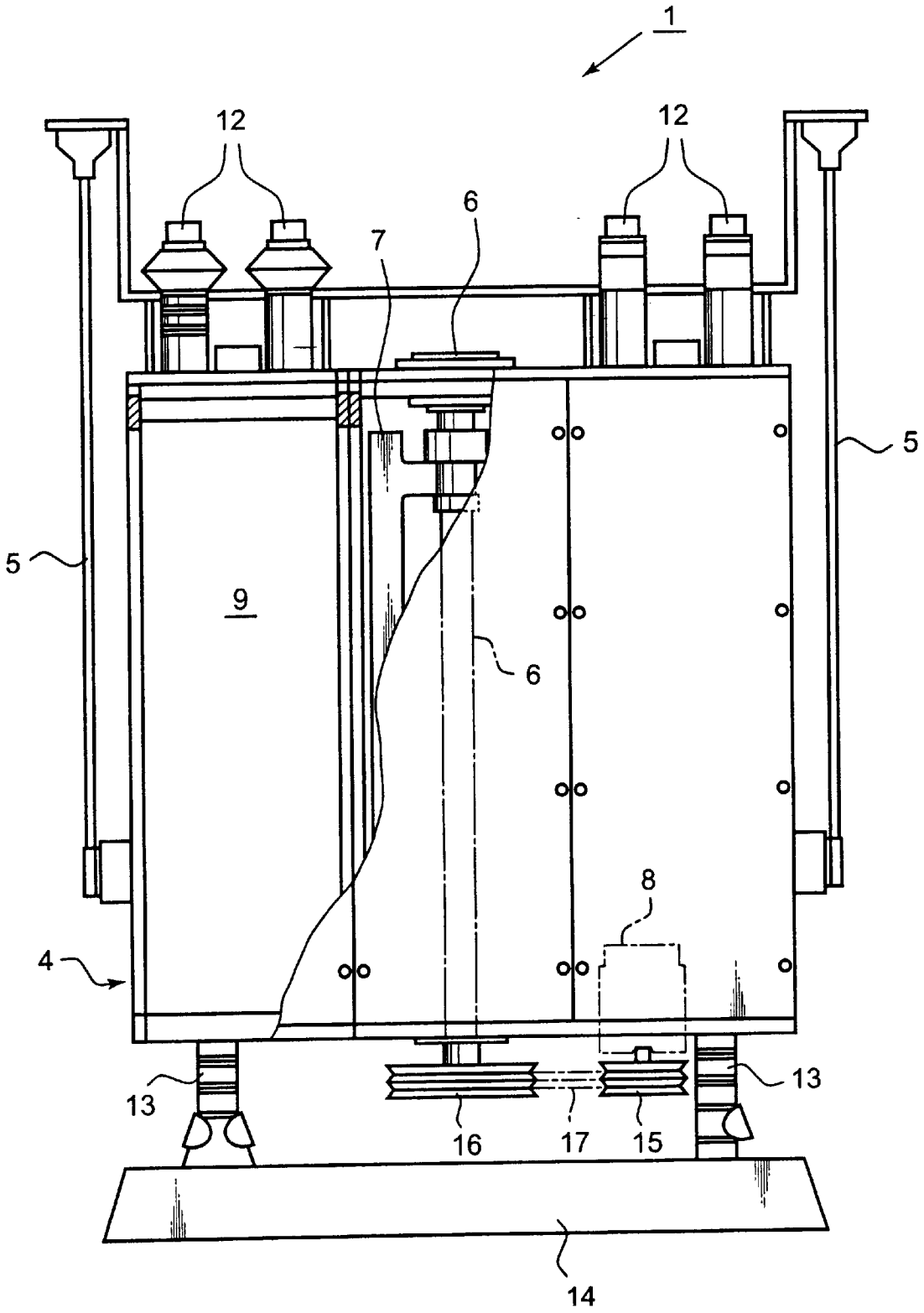
FIG. 3 is a view diagrammatically showing a driving section of the plan sifter according to the invention.

FIG. 2 is a perspective view showing the overall plan sifter 1 according to the invention, and FIG. 3 is a diagram showing a driving portion of the plan sifter 1. In the plan sifter 1, a number of sifter frames 2 are stacked and accommodated into the machine frame 4, the machine frame 4 is suspended by rods 5 from a ceiling beam of a built structure, an unbalanced weight 7 is provided to a shaft 6, whereby the shaft 6 is caused to rotate and the machine frame is caused to oscillate with respect to a horizontal plane and thus the sifting is performed. The shaft 6 is provided substantially in the center of the machine frame 4, and the unbalanced weight 7 is provided to the shaft 6 within the machine frame (see FIG. 3), and the shaft 6 is caused to be rotated and oscillated by a motor 8 disposed under the machine frame 4. The numeral 15 represents a motor pulley provided to a motor shaft of the motor 8, the numeral 16 represents a driving pulley provided at a lower part of the shaft 6, and the numeral 17 represents a belt connecting between the motor pulley 15 and the driving pulley 16.

In the plan sifter 1 shown in FIG. 2, there are eight sifting chambers 9 within the machine frame 4, and the sifting chambers 9A, 9B at the front side are seen with the doors 10 having been removed. Sifting chambers 9*c* and 9*d* are covered by the doors 10. This view shows the state in which the exchange operation of the sifter frames is being performed by workers or operators 11. The numeral 12 represents inlet sleeves each connected to an upper part of the machine frame 4 for supplying particles to each of the sifting chambers 9, and there are three inlet sleeves 12 connected to one sifting chamber. The numeral 13 represents outlet sleeves connected to a lower part of the machine frame 4 for discharging the particles classified into a plurality of classes by the sifting nets. The numeral 14 represents outlet boxes for collecting the outlet sleeves 13.

The plan sifter 1 is ready to be operated when a plurality of sifter frames 2 are accommodated into each of the sifting chambers 9. At the maintenance, the plurality of sifter frames 2 are taken out from each of the sifting chambers 9 and the maintenance work such as exchange of the sifter frames 2 is performed and, in doing so, by utilizing a sifter frame holding means 3 and a sifter frame transporting means 18, it is possible to reduce the heavy labor involved in the exchanging of the sifter frames 2, and reduce the risk involved therein, and to facilitate easy exchanging operation.

Figure 4:
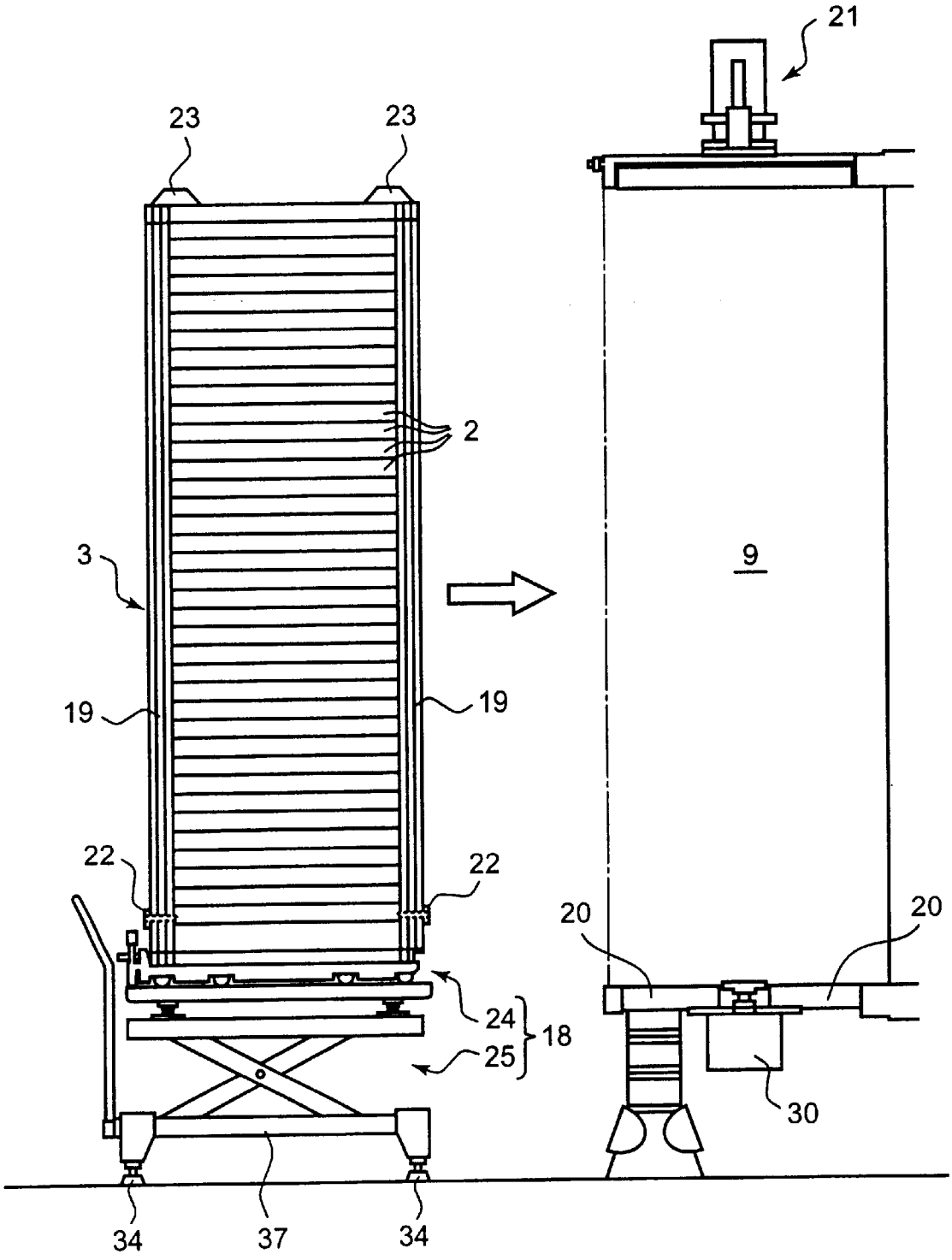
FIG. 4 is a diagrammatic longitudinal sectional view showing a sifter frame holding means and a sifter transporting means according to the invention.

FIG. 4 is a diagrammatic longitudinal sectional view of the sifter frame holding means 3 and the sifter transporting means 18 of the plan sifter 1. The sifter frame holding means 3 is configured by reinforcing frames 19 which support four corners of the plurality of the sifter frames 2 and enable the vertical stacking of the plurality of the sifter frames 2. The reinforcing frames 19 may be formed by, for example, a lightweight aluminum material. A lower part of each reinforcing frame 19 is held by, for example, a screw 22 which is detachably screwed from the outside to the vertically stacked sifter frames 2, and an upper part of each reinforcing frame 19 has a hook member 23 which is hooked to the uppermost sifter frame 2 so that the overall sifter frames are held in place. In the sifting chamber 9, there are provided a bottom part 20 on which the sifter frames 2 together with the reinforcing frames 19 are disposed, a sifter frame fixing means 21 which presses all the sifter frames 2 downwardly from above and closes them tightly for preventing any leakage of the particles, and a sifter frame elevating means 30 which is provided at the bottom part 20 of the sifting chamber 9 for lifting a large number of sifter frames 2 stacked vertically. When the sifter frames 2 together with the reinforcing frames 19 are accommodated into the sifting chamber 9, the sifter frames 2 are subjected to the pressure by the sifter frame fixing means 21.

Further, the sifter frame transporting means 18 is provided with a rolling cart 24 on which a plurality of stacked sifter frames 2 together with the reinforcing frames 19 are placed and moved to and from the sifting chamber 9, and a moving cart 25 on which the plurality of stacked sifter frames 2 together with the rolling cart 24 are placed, and which enables the movement of the stacked sifter frames 2 to a place separated from the plan sifter 1 thus providing a larger space for easy operation.

Figure 5:
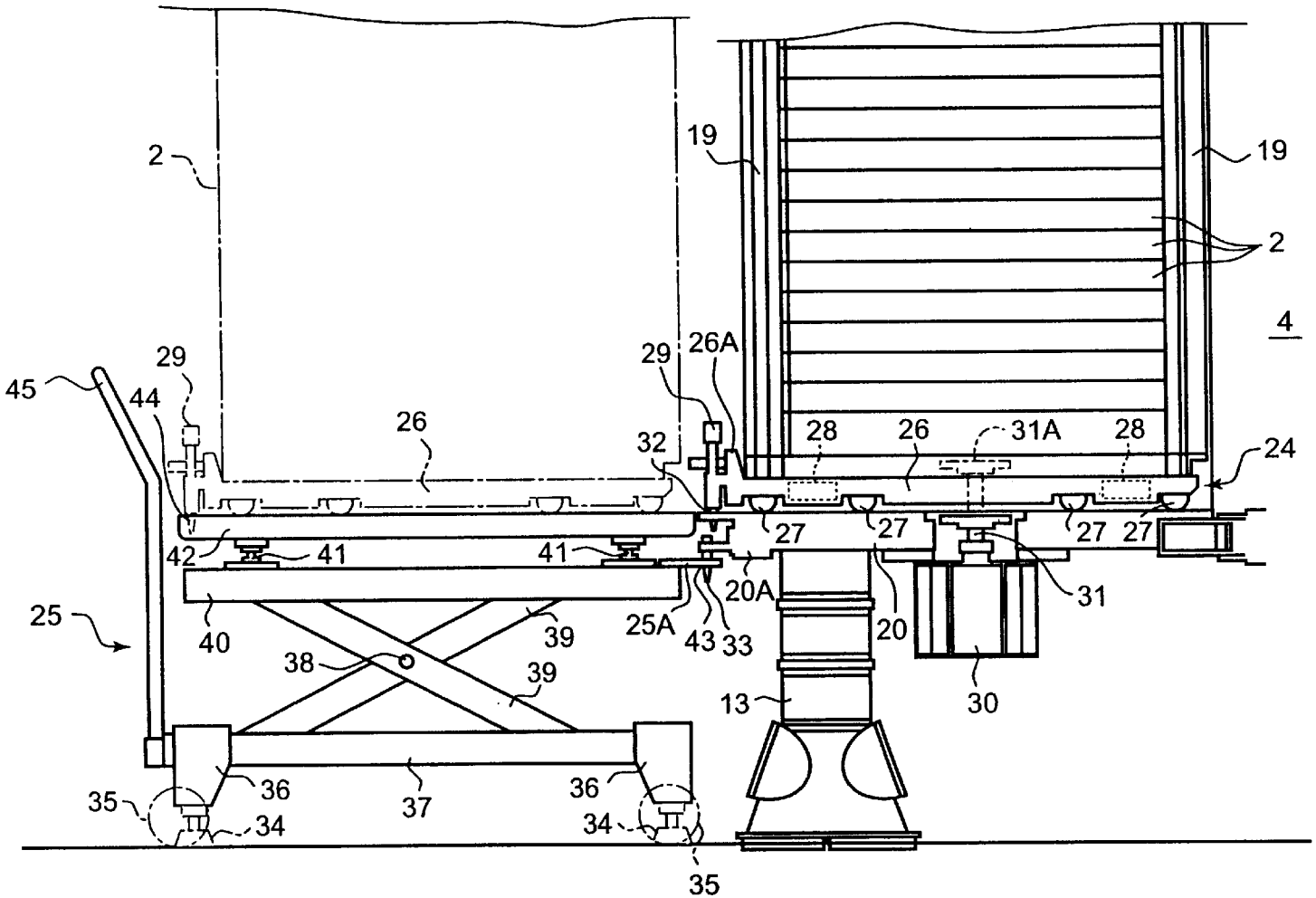
FIG. 5 is a diagrammatic enlarged view of a rolling cart and a moving cart according to the invention.

FIG. 5 is a diagrammatic enlarged view of the rolling cart 24 and the moving cart 25. The rolling cart 24 is provided mainly with a cart portion 26 in a low floor form on which the sifter frames 2 are placed, a plurality of rollers 27 which are provided under a bottom surface of the cart portion 26 and which can rotate in any direction without directivity, a pair of fork holes 28, 28 which are provided respectively at the front and rear portions of the cart portion 26 and in which forks of a fork lift are inserted, and a lock pin 29 which is provided at the rear portion 26A of the cart portion 26 and which locks the rolling cart 24 to the moving cart 25 or to the bottom part 20 of the sifting chamber 9. Further, at a bottom part 20 of the sifting chamber 9, there is provided an air cylinder 30 which serves as the sifter frame elevating means for elevating the accommodated entire sifter frames 2. In order to avoid interference with the cart portion 26 when the rod 31 of the air cylinder is extended, the rolling cart 24 is branched into two at a center portion (in a depth direction which FIG. 5 does not show). In this way, when the rod 31 is extended, the rolling cart 24 can be drawn out from the sifting chamber 9.

The air cylinder 30 provided at the center portion of the bottom part 20 of the sifting chamber 9 functions to elevate the sifter frames 2 when the rod 31 thereof moves toward the position shown by the numeral 31A. Also, the front end 20A of the bottom part 20 has a pin-hole 32 which receives the lock pin 29 of the rolling cart 24 and, under the pin-hole 32, there is provided a hitch 33 which connects the front end 20A of the bottom part 20 to the forefront 25A of the moving cart 25 so that the moving cart 25 is not separated from the sifting chamber 9. The numeral 13 represents, as before, the outlet sleeves and the numeral 4 represents the machine frame which accommodates driving portions such as the shaft 6 and the unbalanced weight 7.

Next, the moving cart 25 is explained. The moving cart 25 is one which is remodeled from a commercially available lifter, and includes mainly a leg portion 36 provided with horizontally adjustable legs 34 and moving casters 35, a base portion 37 supported by the leg portion 36, jack portions 39, 39 capable of making an appropriate jack up by screw or hydraulic mechanisms with a fulcrum point 38 as the center, a lift base 40 raised to an appropriate height by the jack portions 39, 39, and a placement base 42 provided on the lift base 40 with the horizontally adjusting portions 41, 41 being interposed. The numeral 43 represents a hitch hole which receives the hitch 33 provided so that the moving cart 25 is not separated from the sifting chamber 9, the numeral 44 presents a pin-hole which receives the lock pin 29 when the rolling cart 24 is placed, and the numeral 45 represents a handle of the moving cart 25.

Figure 6:
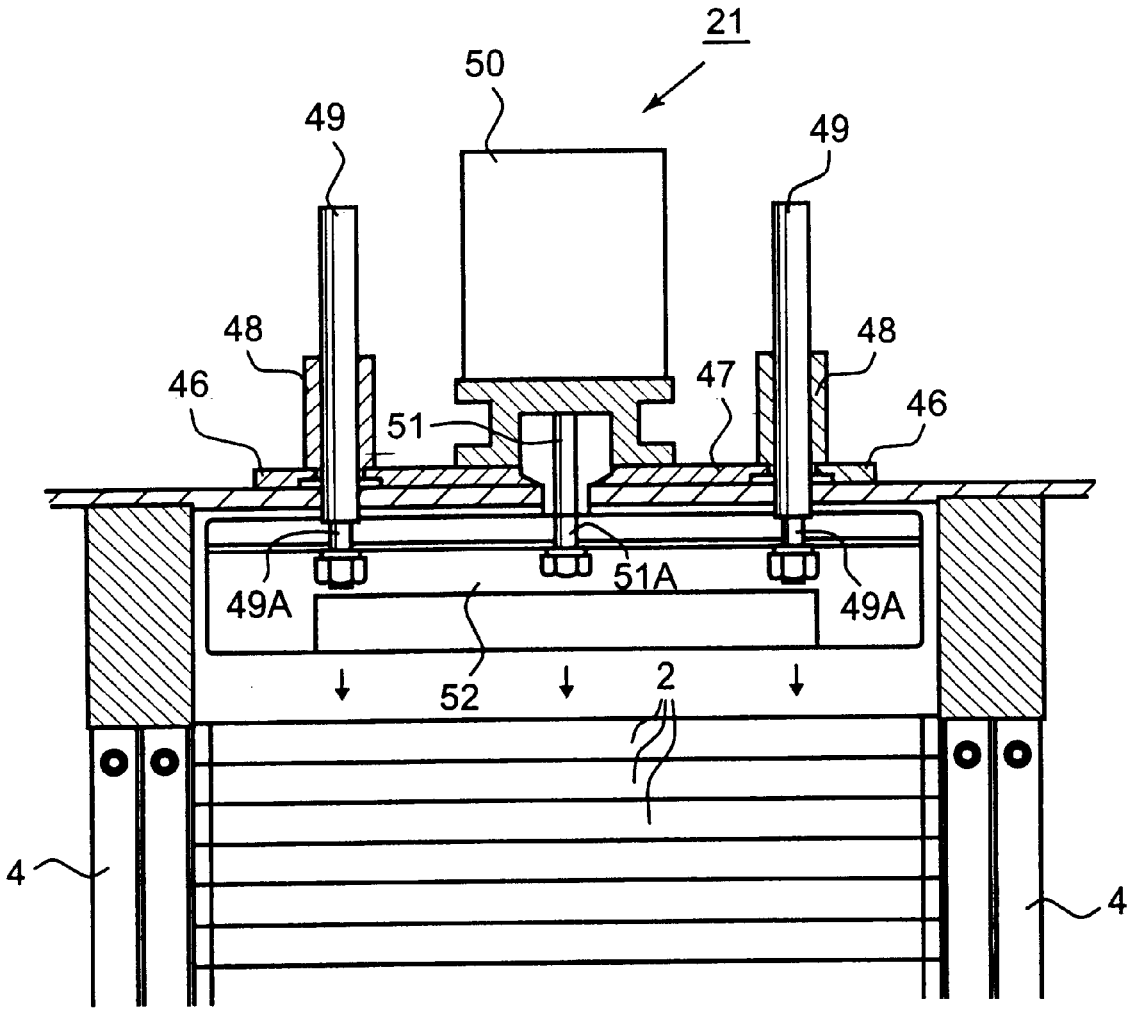
FIG. 6 is a longitudinal sectional view showing details of a sifter fixing means provided in a sifting chamber according to the invention.

FIG. 6 is a longitudinal sectional view showing details of a sifter frame fixing means 21 provided in the sifting chamber 9. The sifter frame fixing means 21 provided at an upper portion of the machine frame 4 is configured by base portions 46, 46, 47 fixed at the upper portion of the machine frame 4; at least two guides 48, 48 connected to the base portions 46, 46, 47; guide shafts 49, 49 vertically extending from each of the guides 48, 48 from above to downward; a pressing means such as an air cylinder 50 fixed at the center portion of the base portion 47; and a sifter frame pressing member 52 which is attached by, for example, bolts to the lower portions 49A, 49A of the guide shafts 49, 49 and the lower end 51A of an actuator 51 of the air cylinder 50 and which presses from above to downward the sifter frames 2 accommodated in the sifting chamber 9. The sifter frame pressing member 52 is enabled to press the sifter frames 2 vertically from above to downward by the two guide shafts 49, 49 and the one air cylinder 50.

Now, the function of the sifter as constructed above is explained.

First, explanation is made of the operation relating to the accommodation of a plurality of sifter frames 2 into each sifting chamber 9 of the plan sifter 1. FIG. 4 shows a state in which, as a preparatory operation, the necessary number of sifter frames 2 are stacked in advance. The work involved is to move the moving cart 25 to an area having a wide space for easy operation, and to fix the horizontally adjusting legs 34, 34, to stabilize the moving cart 25, and to hold the base portion 37 in a horizontal position. Next, the jack portions 39 are adjusted so that the placement base 42 becomes substantially the same height as that of the bottom part 20 of the sifting chamber 9. Then, the rolling cart 24 is placed on the placement base 42, the lock pin 29 is inserted into the pin-hole 44 to lock the rolling cart 24, and a plurality of sifter frames 2 are stacked sequentially one after another on the rolling cart 24. For example, the sifter frames 2 may be stacked such that the meshes of the nets become gradually finer from the upper stage towards lower stages, and the particles are introduced from the uppermost stage. The sifter frames 2 may be stacked such that, closer to the bottom stage, finer sifted particles can be taken out. The sifter frames 2 may be stacked in a predetermined number, for example, 30 stages, and lastly the hook portions 23 of the reinforcing frames 19 may be hooked to the uppermost sifter frame 2, and the overall sifter frames are fixed by the screws 22. Then, the moving casters 35 of the leg portions 36 of the moving cart 25 are caused to be projected out, and the stacked sifter frames 2 together with the moving cart 25 are in a condition of being able to move.

Next, the moving cart 25 is moved to the front of the related sifting chamber 9 of the plan sifter 1, and the stacked sifter frames 2 are exchanged at once. When no sifter frames 2 are in the sifting chamber 9 (refer to FIG. 2 and FIG. 4), no operation of taking out the sifter frames 2 in advance to the exchanging operation is necessary, so that the worker 11 may remove a door 10 of the sifting chamber 9 and proceed straight to accommodating the stacked sifter frames.

Figure 7:
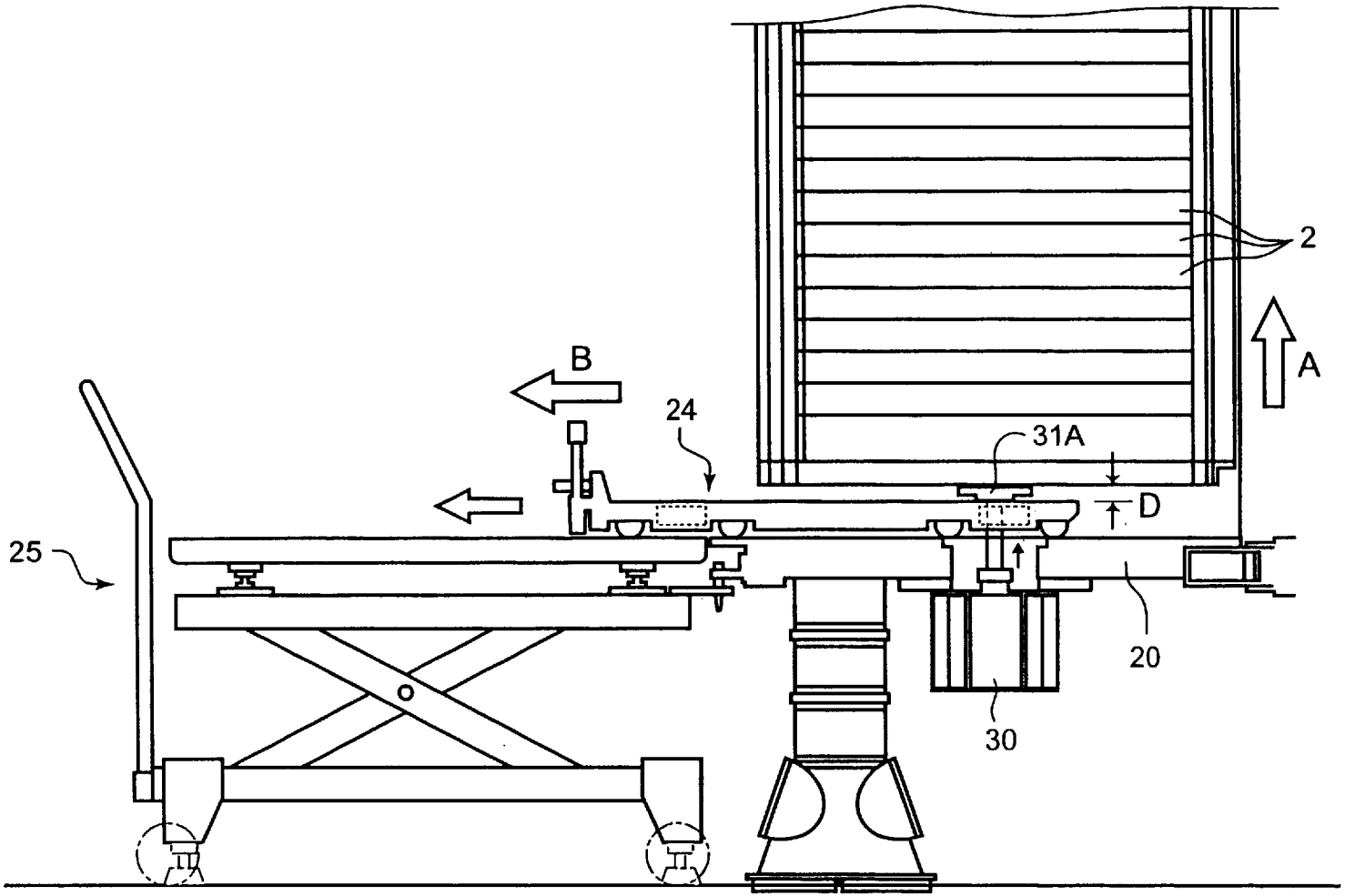
FIG. 7 is a diagrammatic enlarged view showing operations of the rolling cart and the moving cart according to the invention.

Now, explanation is made with reference to FIG. 5 and FIG. 7. When the moving cart 25 is moved to the front of the sifting chamber 9, the leg portion 36 of the moving cart 25 is fixed by the horizontally adjusting legs 34, 34 instead of the moving casters 35, 35, and the front end 20A of the bottom part 20 and the forefront 25A of the moving cart 25 are connected by the hitch 33 so that the moving cart 25 is not separated from the sifting chamber 9. Then, the jack portions 39, 39 of the moving cart 25 effect a fine adjustment so as to adjust the height of the placement base 42 of the moving cart 25 to the height of the bottom part 20 of the sifting chamber 9. Then, the lock pin 29 is released from the pin-hole 44 of the moving cart 25, and the sifter frames 2 together with the rolling cart 24 are pushed into the sifting chamber 9.

In the state of FIG. 5, the rolling cart 25 is on the bottom part 20 of the sifting chamber 9, and it is necessary for the rolling cart 24 to be pulled out from the sifting chamber 9. FIG. 7 is a diagrammatic enlarged view of the rolling cart 24, showing a state in which the rolling cart 24 is being drawn out from the sifting chamber 9. When the sifter frames 2 are accommodated in the sifting chamber 9, first the air cylinder 30 is driven, and the rod 31 extends. Then, the entire sifter frames 2 are raised in the direction of the arrow A on FIG. 7, so that a small gap D is produced between the lowermost sifter frame 2 and the rolling cart 24. Because of this gap D, the rolling cart 24 is free from the load of the sifter frames 2, thus allowing the rolling cart 24 to be pulled out in the direction of the arrow B. When the rolling cart 24 has completely been pulled out from the sifting chamber 9, the rod 31 of the air cylinder 30 is lowered to the original position, the sifter frames 2 are placed on the bottom part 20, and the entire sifter frames 2 are fixed by the sifter frame fixing means 21.

Upon the air cylinder 50 being actuated, the sifter frame pressing member 52 of the sifter frame fixing means 21 is enabled to press the sifter frames 2 downwardly from above by the two guide shafts 49, 49 and the one air cylinder 50.

In this way, for the work required for exchanging the sifter frames, the heavy labor can be widely reduced by the use of the rolling cart 24 and the moving cart 25. Also, in the operation of exchanging the sifter frames 2, the horizontally adjusting legs 34, 34 enable the reduction of instability of the moving casters 35, the lock pin 29 enables the secured fixing between the moving cart 25 and the rolling cart 24, and the hitch 33 enables the secured fixing of the moving cart 25 and the sifting chamber 9, so that the risk involved in the exchanging operation is reduced, and the work involved in exchanging the sifter frames is made easy.

The comparison of the time required for exchanging the sifter frames in a conventional plan sifter and that required for exchanging the sifter frames in the plan sifter according to the present invention is as shown in the following table.

TABLE 1

| KIND OF WORK | CONVENTIONAL | PRESENT INVENTION |
|---|---|---|
| Removal and attachment of door | 10 minutes | 10 minutes |
| Removal and accommodation of sifter frame | 40 minutes | 25 minutes |
| Pressing of sifter frame | 20 minutes | 5 minutes |
| Cleaning | 15 minutes | 7 minutes |
| TOTAL | 85 minutes | 47 minutes |

(The Table Shows the Time Required by Two Workers Per Sifting Chamber)

As compared with the operation in the conventional plan sifter in which it was necessary to take out the sifter frames one at a time from the sifting chamber to inspect the existence of any problems, such as holes in the nets, loosening of the nets, leakage of particle objects, etc. and to exchange the sifter frames if any such problems do exist, the operation in the sifter according to the present invention requires only the exchanging with the new sifter frames 2 stacked in advance, thus making the operation easy and making a large reduction in the operating time.

Figure 8:
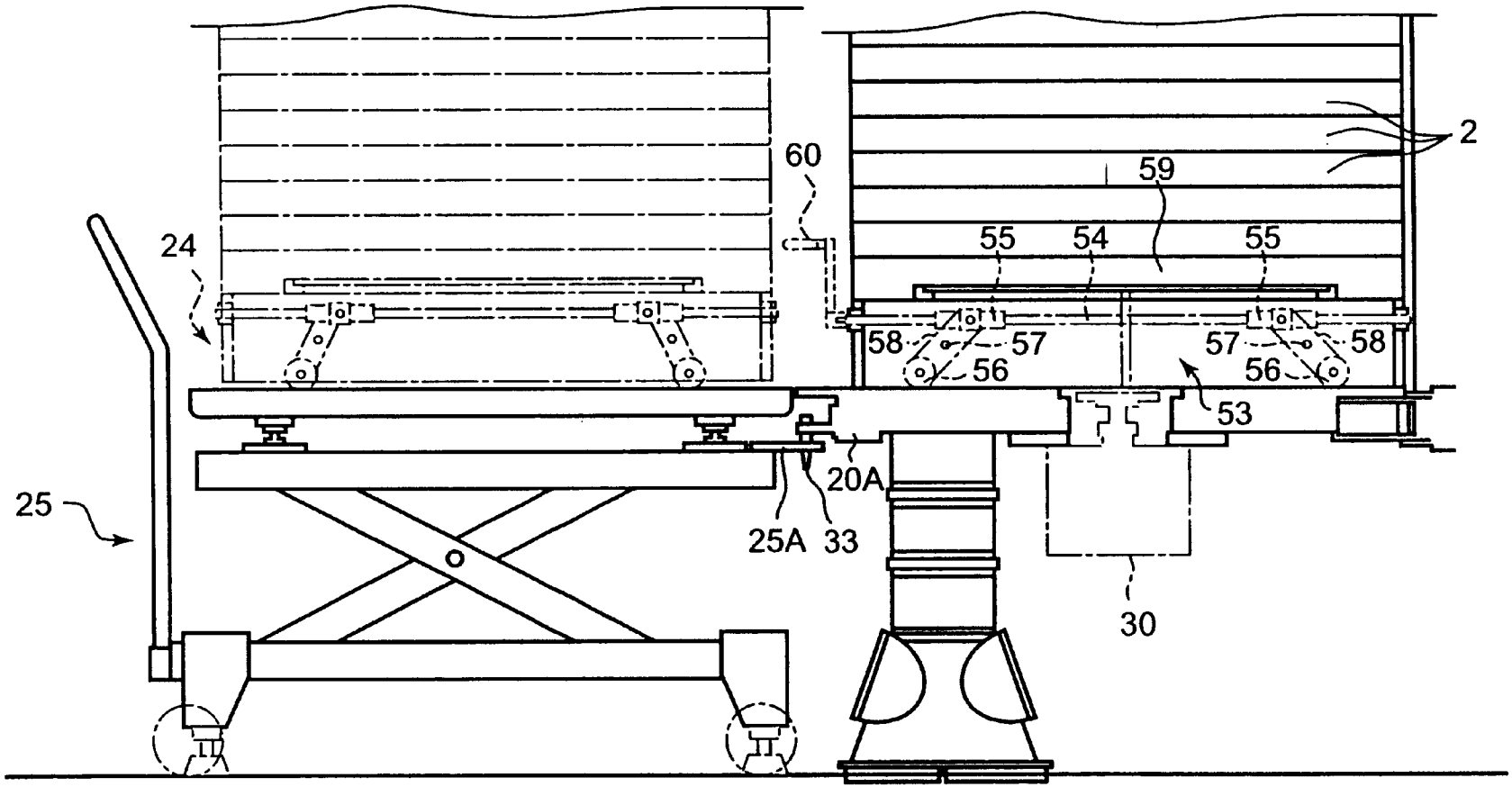
FIG. 8 is a diagrammatic enlarged view showing a rolling cart and a moving cart in another embodiment according to the invention.

FIG. 8 is a diagrammatic enlarged view of a rolling cart 24 and a moving cart 25 in another embodiment according to the invention. In this configuration, it is not necessary to pull out from the sifting chamber 9 the rolling cart 24 placed on the bottom part 20 of the sifting chamber 9 as described above so that the time required can further be reduced.

The rolling cart 24 shown in FIG. 8 includes a bottom box 53 on which the sifter frames 2 are placed, a plurality of moving casters 56, 56, a screw shaft 54 laterally extending with the bottom box 53, a plurality of nut tubes 55, 55 which screw-engage with the screw shaft 54, a plurality of jack portions 58, 58 each having one end connected to the related nut tube 55 and the other end connected to the related moving caster 56 and having a mechanism to allow the in- and out-movements of the moving caster 56 from the bottom box 53 with the related fulcrum point 57 as the center, and a sifter frame base 59 on which the bottom box 53 is placed. The numeral 60 represents a handle which turns the screw shaft either to the right or left. By the turning of the handle 60, the moving casters 56, 56 can come in or come out of the bottom box 53.

Function of the above configured arrangement is explained. Similarly as in the foregoing, the preparatory work is made by moving the moving cart 25 to a place having a wider space to facilitate easy work, the rolling cart 24 is placed on the moving cart 25, and a plurality of sifter frames 2 are sequentially stacked on the rolling cart 24. The sifter frames 2 may be stacked in such a way that the meshes of the nets become gradually finer from the top towards the lower stages. Further, the sifter frames 2 are fixed after a predetermined number of stages, for example, 30 stages are stacked. In this case, in order to prevent the movement of the rolling cart 24, the handle 60 is rotated and the moving casters 56, 56 are caused to be moved and hidden into the bottom box 53.

Next, the moving cart 25 is moved to the front of the sifting chamber 9 of the plan sifter 1, and the stacked sifter frames 2 are exchanged at once. At this time, in order to move the rolling cart 24, the handle 60 is rotated and the moving casters 56, 56 are caused to be out of the bottom box 53. Then, for the moving cart 25 not to be separated from the sifting chamber 9, the front end 20A of the bottom part 20 and the forefront 25A of the moving cart 25 are connected with each other by the hitch 33, and the sifter frames 2 together with the rolling cart 24 are pushed into the sifting chamber 9. Thereafter, for the rolling cart 24 not to be moved, the handle 60 is rotated and the moving casters 56, 56 are caused to be hidden in the bottom box 53. The bottom box 53 provided with the moving casters 56, 56 is in a closed state, unlike the above described cart portion 26 in the low floor form, there occurs no leakage of particles even when the bottom box is fixed together with the sifter frames 2 by the sifter frame fixing means 21. That is., unlike the cart portion 26 as described above, the bottom box 53 is not required to be pulled out from the sifting chamber 9, and it is also not necessary to provide, for elevating the entire sifter frames 2, the air cylinder 30 to the bottom part 20 of the sifting chamber 9. When the sifter frames 2 are to be moved out from the sifting chamber 9, the handle 60 is rotated for the moving casters 56, 56 to come out of the bottom box 53 and, thereafter, the sifter frames 2 may be pulled out.

As explained above, the invention provides a sifter frame exchanging method comprising the steps of: stacking the plurality of sifter frames in advance outside the machine frame and holding the sifter frames in a unitary form; placing the unitary formed sifter frames in the sifting chamber when accommodating the sifter frames in the sifting chamber; fixing the unitary formed sifter frames accommodated in the sifting chamber; releasing the fixing of the sifter frames when drawing out the sifter frames from the sifting chamber; and drawing out the sifter frames to outside the machine frame in the state in which the sifter frames are stacked in the unitary form. With the above configuration, when the sifter frames are taken out from a plurality of sifting chambers provided in the machine frame, it is not necessary to take out the sifter frames one at a time from each sifting chamber to inspect the existence of any holes in the nets, any problem in the tense condition of the nets, any leakage of particle objects, etc. and then to exchange the sifter frames and, when the sifter frames are accommodated into each of the sifting chambers, the sifter frames are stacked in advance outside the machine frame and the sifter frames in the unitary state are accommodated in each sifting chamber so that, even when the number of the sifter frames is large, the exchanging operation can be easily carried out. For example, in the case of the plan sifter where there are 20 to 30 stages of the sifter frames in each sifting chamber and there are six sifting chambers in total, the time required for exchanging operation was about 80 minutes for each chamber but this has been reduced to about 40 minutes, half the time, and in the case of the sifter having six sifting chambers, only about four hours are required, half the time which was conventionally required.

In the apparatus for exchanging sifter frames of a plan sifter, there are provided with means to stack a plurality of sifter frames and to hold the sifter frames in a unitary form; means to transport the unitary formed sifter frames to the sifting chamber for accommodating the sifter frames in the sifting chamber, and from the sifting chamber for drawing out the sifter frames; and means to fix the sifter frames by giving pressure vertically downwardly from above to the sifter frames accommodated in the sifting chamber. With the sifter frame holding means, the stacked sifter frames can be unitarily held and, with the sifter frame transporting means, the sifter frames can be carried out easily to outside the machine frame. In fixing the sifter frames within the sifting chamber, the stacked sifter frames have conventionally been fixed by bolts and nuts. However, according to the invention, the stacked sifter frames are automatically fixed or released by the sifter frame fixing means thereby enabling to reduce the work and labor involved in the operation.

In the sifter frame transporting means, there are provided a first moving cart for moving the unitary formed sifter frames from a location at which the sifter frames are in contact with the machine frame to a predetermined location different from a location of the machine frame, and a second moving cart for moving, when the first cart is at the location at which the sifter frames are in contact with the machine frame, the unitary formed sifter frames between aboard the first moving cart and inside the sifting chamber; whereby, when the sifter frames are accommodated in the sifting chamber, the first moving cart is moved to the predetermined location different from the location of the machine frame, the unitary formed sifter frames are placed via the second moving cart on the first moving cart, further the first moving cart is moved to the location at which the sifter frames are in contact with the machine frame and, after the second moving cart is moved to inside the sifting chamber from aboard the first moving cart, the second moving cart is drawn out and the sifter frames are accommodated; and when the sifter frames are drawn out from the sifting chamber, the first moving cart is moved to the location at which the sifter frames are in contact with the machine frame, the second moving cart is inserted into a bottom portion of the unitary formed sifter frames, and the second moving cart is moved aboard the first moving cart from inside the sifting chamber and the sifter frames are drawn out.

In the sifter frame transporting means, there are provided a first moving cart for moving the unitary formed sifter frames from a location at which the sifter frames are in contact with the machine frame to a predetermined location different from a location of the machine frame, and a second moving cart for moving, when the first cart is at the location at which the sifter frames are in contact with the machine frame, the unitary formed sifter frames between aboard the first moving cart and inside the sifting chamber; and the sifter frame fixing means includes a sifter frame fixing device provided above the sifting chamber and giving pressure vertically downwardly from above to the sifter frames accommodated in the sifting chamber, and an elevating means provided below the sifter frame fixing device and allowing the upward-and-downward movements of the unitary formed sifter frames accommodated in the sifting chamber. According to the plan sifter having this configuration, with the first moving cart, a plurality of sifter frames can be stacked in advance outside the machine frame to stand by and, with the second moving cart, the unitary formed sifter frames may be pushed into the sifting chamber so that, with a simple operation, the sifter frames can be exchanged. Also, the sifter frame fixing device facilitates the unitary formed sifter frames to be easily fixed or released. Further, when the second moving cart is drawn out from the unitary formed sifter frames at the sifting chamber, the sifter frame elevating means may be operated so that, while the unitary formed sifter frames are elevated, the second moving cart may easily be drawn out.

The first moving cart includes a leg portion having horizontally adjusting legs and casters, a base portion supported by the leg portion, a jack portion capable of appropriately jacking up the base portion with the fulcrum point as the center, a lift base for raising the jack portion to an appropriate height, and a placement base provided on the lift base with a horizontally adjusting portion interposed therebetween. The first moving cart is enabled to move by the casters and, during the operation, the horizontally adjusting legs may be in a fixed position so as to make the moving cart stable. Further, the placement base can be adjusted by the jack portion so that the height thereof can be substantially the same as that of the bottom portion of the sifting chamber of the sifter.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A method for exchanging sifter frames of a plan sifter, in which a plurality of sifter frames having nets of different meshes are stacked one on top of the other, the stacked sifter frames are accommodated and fixed in a sifting chamber provided in a machine frame, and said machine frame is suspended from above and caused to be oscillated or shaken for sifting powdery particles, said method comprising the steps of:

stacking said plurality of sifter frames in advance outside said machine frame and holding said sifter frames in a unitary form;

placing the unitary formed sifter frames in said sifting chamber when accommodating said sifter frames in said sifting chamber;

fixing said unitary formed sifter frames accommodated in said sifting chamber;

releasing the fixing of said sifter frames when drawing out said sifter frames from said sifting chamber;

drawing out said sifter frames to outside said machine frame in the state in which said sifter frames are stacked in the unitary form; and elevating said unitary formed sifter frames upwardly and downwardly when accommodating and drawing out said sifter frames in and from said sifting chamber.

2. An apparatus for exchanging sifter frames of a plan sifter, in which a plurality of sifter frames having nets of different meshes are stacked one on top of the other, the stacked sifter frames are accommodated and fixed in a sifting chamber provided in a machine frame, and said machine frame being suspended from above and caused to be oscillated or shaken for sifting powdery particles, said apparatus comprising:

means to stack said plurality of sifter frames and hold said sifter frames in a unitary form;

means to transport said unitary formed sifter frames to said sifting chamber for accommodating said sifter frames in said sifting chamber, and from said sifting chamber for drawing out said sifter frames;

means to elevate said unitary formed sifter frames upwardly and downwardly when said sifter frames are accommodated in and drawn out from said sifting chamber; and means to fix said sifter frames by giving pressure vertically downwardly from above to said sifter frames accommodated in said sifting chamber.

3. An apparatus for exchanging sifter frames of a plan sifter according to claim 2, in which said means to transport the sifter frames includes a first moving cart for moving said unitary formed sifter frames from a location at which said sifter frames are in contact with said machine frame to a predetermined location different from a location of said machine frame, and a second moving cart for moving, when said first cart is at the location at which said sifter frames are in contact with said machine frame, said unitary formed sifter frames between aboard said first moving cart and inside said sifting chamber;

whereby, when said sifter frames are accommodated in said sifting chamber, said first moving cart is moved to the predetermined location different from the location of said machine frame, said unitary formed sifter frames are placed via said second moving cart on said first moving cart, further said first moving cart is moved to the location at which said sifter frames are in contact with said machine frame and, after said second moving cart is moved to inside said sifting chamber from aboard said first moving cart to inside said sifting chamber, said second moving cart is drawn out and the sifter frames are accommodated; and when said sifter frames are drawn out from said sifting chamber, said first moving cart is moved to the location at which said sifter frames are in contact with said machine frame, said second moving cart is inserted into a bottom portion of said unitary formed sifter frames, and said second moving cart is moved from aboard said first moving cart from inside said sifting chamber and the sifter frames are drawn out.

4. An apparatus for exchanging sifter frames of a plan sifter according to claim 3, in which said first moving cart includes a leg portion having horizontally adjusting legs and casters, a base portion supported by said leg portion, a jack portion capable of appropriately jacking up said base portion with a fulcrum point as the center, a lift base for being raised up or down said jack portion to an appropriate height, and a placement base provided on said lift base with a horizontally adjusting portion interposed therebetween.

5. An apparatus for exchanging sifter frames of a plan sifter according to claim 4, in which the apparatus is provided with a first lock means to fix said first moving cart and said sifting chamber, and a second lock means to fix said first moving cart and said second moving cart, said first lock means and said second lock means being used when said unitary formed sifter frames are accommodated in said sifting chamber or taken out from said sifting chamber.

6. An apparatus for exchanging sifter frames of a plan sifter according to claim 3, in which the apparatus is provided with a first lock means to fix said first moving cart and said sifting chamber, and a second lock means to fix said first moving cart and said second moving cart, said first lock means and said second lock means being used when said unitary formed sifter frames are accommodated in said sifting chamber or taken out from said sifting chamber.

7. An apparatus for exchanging sifter frames of a plan sifter according to claim 2, in which:

said means to transport said sifter frames includes a first moving cart for moving said unitary formed sifter frames from a location at which said sifter frames are in contact with said machine frame to a predetermined location different from a location of said machine frame, and a second moving cart for moving, when said first cart is at the location at which said sifter frames are in contact with said machine frame, said unitary formed sifter frames between aboard said first moving cart and inside said sifting chamber; and said means to fix said sifter frames includes a sifter frame fixing device provided above said sifting chamber and giving pressure vertically downwardly from above to the sifter frames accommodated in said sifting chamber.

8. An apparatus for exchanging sifter frames of a plan sifter according to claim 7, in which said first moving cart includes a leg portion having horizontally adjusting legs and casters, a base portion supported by said leg portion, a jack portion capable of appropriately jacking up said base portion with a fulcrum point as the center, a lift base for being raised up or down said jack portion to an appropriate height, and a placement base provided on said lift base with a horizontally adjusting portion interposed therebetween.

9. An apparatus for exchanging sifter frames of a plan sifter according to claim 7, in which the apparatus is provided with a first lock means to fix said first moving cart and said sifting chamber, and a second lock means to fix said first moving cart and said second moving cart, said first lock means and said second lock means being used when said unitary formed sifter frames are accommodated in said sifting chamber or taken out from said sifting chamber.

10. An apparatus for exchanging sifter frames of a plan sifter according to claim 7, in which:

said second moving cart is configured by a cart portion in a low floor form on which said unitary formed sifter frames are placed, and by wheels provided under a bottom surface of said cart portion, and said elevating means are configured by an air cylinder for elevating said unitary formed sifter frames separately from said cart portion.

11. An apparatus for exchanging sifter frames of a plan sifter according to claim 10, in which said first moving cart includes a leg portion having horizontally adjusting legs and casters, a base portion supported by said leg portion, a jack portion capable of appropriately jacking up said base portion with a fulcrum point as the center, a lift base for being raised up or down said jack portion to an appropriate height, and a placement base provided on said lift base with a horizontally adjusting portion interposed therebetween.

12. An apparatus for exchanging sifter frames of a plan sifter according to claim 10, in which the apparatus is provided with a first lock means to fix said first moving cart and said sifting chamber, and a second lock means to fix said first moving cart and said second moving cart, said first lock means and said second lock means being used when said unitary formed sifter frames are accommodated in said sifting chamber or taken out from said sifting chamber.

13. An apparatus for exchanging sifter frames of a plan sifter according to claim 7, in which:

said second moving cart is configured by a bottom box on which said unitary formed sifter frames are placed, and by wheels provided inside said bottom box and allowed to come in and out of said bottom box; and said elevating means are configured by said wheels allowed to come in and out of said bottom box.

14. An apparatus for exchanging sifter frames of a plan sifter according to claim 13, in which said first moving cart includes a leg portion having horizontally adjusting legs and casters, a base portion supported by said leg portion, a jack portion capable of appropriately jacking up said base portion with a fulcrum point as the center, a lift base for being raised up or down said jack portion to an appropriate height, and a placement base provided on said lift base with a horizontally adjusting portion interposed therebetween.

15. An apparatus for exchanging sifter frames of a plan sifter according to claim 13, in which the apparatus is provided with a first lock means to fix said first moving cart and said sifting chamber, and a second lock means to fix said first moving cart and said second moving cart, said first lock means and said second lock means being used when said unitary formed sifter frames are accommodated in said sifting chamber or taken out from said sifting chamber.

* * * * *